US010418749B2

(12) United States Patent
Ochiai

(10) Patent No.: US 10,418,749 B2
(45) Date of Patent: Sep. 17, 2019

(54) ELECTRICAL CONNECTOR WITH AN INNER RECEPTACLE AND OUTER RECEPTACLE

(71) Applicant: Sumitomo Wiring Systems, Ltd., Yokkaichi, Mie (JP)

(72) Inventor: Wataru Ochiai, Mie (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 15/996,623

(22) Filed: Jun. 4, 2018

(65) Prior Publication Data

US 2018/0366869 A1 Dec. 20, 2018

(30) Foreign Application Priority Data

Jun. 19, 2017 (JP) ..... 2017-119229

(51) Int. Cl.

| | |
|---|---|
| ***H01R 13/64*** | (2006.01) |
| ***H01R 13/56*** | (2006.01) |
| ***H01R 13/502*** | (2006.01) |
| ***H01R 13/422*** | (2006.01) |
| *H01R 9/05* | (2006.01) |
| *H01R 13/434* | (2006.01) |
| *H01R 24/38* | (2011.01) |
| *H01R 107/00* | (2006.01) |

(52) U.S. Cl.

CPC ..... *H01R 13/56* (2013.01); *H01R 13/4226* (2013.01); *H01R 13/502* (2013.01); *H01R 9/05* (2013.01); *H01R 13/434* (2013.01); *H01R 13/64* (2013.01); *H01R 24/38* (2013.01); *H01R 2107/00* (2013.01)

(58) Field of Classification Search

CPC ..... H01R 24/38; H01R 13/64

USPC ..... 439/578, 675, 827, 677, 680

See application file for complete search history.

(56) References Cited

U.S. PATENT DOCUMENTS

| | | | | |
|---|---|---|---|---|
| 6,604,961 | B2 * | 8/2003 | Ichioka | H01R 9/05 439/578 |
| 2004/0110425 | A1 * | 6/2004 | Miyake | H01R 13/64 439/677 |
| 2018/0109033 | A1 * | 4/2018 | Tashiro | H01R 13/501 |

FOREIGN PATENT DOCUMENTS

| | | |
|---|---|---|
| JP | 5764546 | 6/2015 |

* cited by examiner

*Primary Examiner* — Abdullah A Riyami
*Assistant Examiner* — Justin M Kratt
(74) *Attorney, Agent, or Firm* — Gerald E. Hespos; Michael J. Porco; Matthew T. Hespos

(57) ABSTRACT

A connector includes an inner receptacle (13), an outer receptacle (12) for covering an outer periphery of the inner receptacle (13), a first terminal fitting (50) arranged to project inside the inner receptacle (13), and second terminal fittings (60) arranged to project outside the inner receptacle (13) and inside the outer receptacle (12). A mating housing (80) is fit into the outer receptacle (12). A tip of the inner receptacle (13) is located forward of tips of the first and second terminal fittings (50, 60).

5 Claims, 6 Drawing Sheets

ELECTRICAL CONNECTOR WITH AN INNER RECEPTACLE AND OUTER RECEPTACLE

BACKGROUND

Field of the Invention

The invention relates to a connector.

Description of the Related Art

FIG. 8 of Japanese Patent No. 5764546 discloses a mating connector with a rectangular box-shaped mating housing that includes a fitting recess. A mating connection terminal and a mating power supply terminal are to be accommodated inside the mating housing. A housing of a connector is fittable into the fitting recess of the mating housing. Further, inner and rear guide projections are provided on the inner surface of the fitting recess. The rear guide projection has a function of preventing the prying of the connector with respect to the mating connector according to paragraph 0114 of the specification of Japanese Patent No. 5764546.

An opening diameter of a fitting recess may be increased due to multi-polarization. Thus, a housing easily contacts terminals even if inclined only slightly. Contact of the housing with the terminals is difficult to avoid and prying cannot be impeded sufficiently by a conventional prying preventing rib on a peripheral part of the fitting recess, such as the rear guide projection.

The invention was completed on the basis of the above situation and aims to reliably prevent prying at the time of a connection.

SUMMARY

The invention is directed to a connector with an inner receptacle and an outer receptacle for covering an outer periphery of the inner receptacle. A first terminal fitting is arranged to project inside the inner receptacle, and a second terminal fitting is arranged to project outside the inner receptacle and inside the outer receptacle. A mating housing is fit into the outer receptacle. A tip of the inner receptacle is located forward of tips of the first and second terminal fittings.

A mating housing that is inclined with respect to the outer receptacle when being fit into the outer receptacle will interfere with the tip of the inner receptacle, thereby stopping any further connection. The tip of the inner receptacle is located forward of the tips of the first and second terminal fittings. Thus, contact of the mating housing with the first and second terminal fittings can be avoided. Particularly, the inner receptacle is arranged inside the outer receptacle. Thus, a prying connection of the mating housing can be prevented more reliably, as compared to a conventional case where a prying preventing rib is provided on a peripheral part of the outer receptacle. In addition, the inner receptacle has a function of preventing prying connection of the mating housing and a function of protecting the first terminal fitting. Thus, a configuration can be simplified.

The inner receptacle may include a tubular receptacle body and a prying preventing piece partially projecting from a tip of the receptacle body. According to the present invention, the mating housing is formed with a groove for receiving the inner receptacle. If a projecting dimension of the inner receptacle becomes larger, a cutting depth of the groove also becomes larger, which may cause a reduction in the strength of the mating housing and larger space restrictions. However, the prying preventing piece partially projects from the tip of the receptacle body according to the above configuration. Thus, the mating housing can be left uncut around a part for receiving the prying preventing piece and can be sufficiently strong.

The inner receptacle may be arranged in an inner central part of the outer receptacle. According to this configuration, even if the mating housing is inclined in any direction, e.g. up, down, left or right during prying connection, the mating housing can be set to interfere with the inner receptacle and prying connection of the mating housing is prevented reliably.

The inner receptacle and the outer receptacle may project from a wall surface on a back side. A rib for restricting erroneous connection to the mating housing may project integrally on the inner receptacle and may include a closing end integrally connected to the wall surface. According to this configuration, the inner receptacle also has a function of restricting erroneous connection of the mating housing. Further, an end of the rib is connected integrally to the wall surface on the back side, so that the strength of the inner receptacle can be improved.

DETAILED DESCRIPTION

Figure 1:
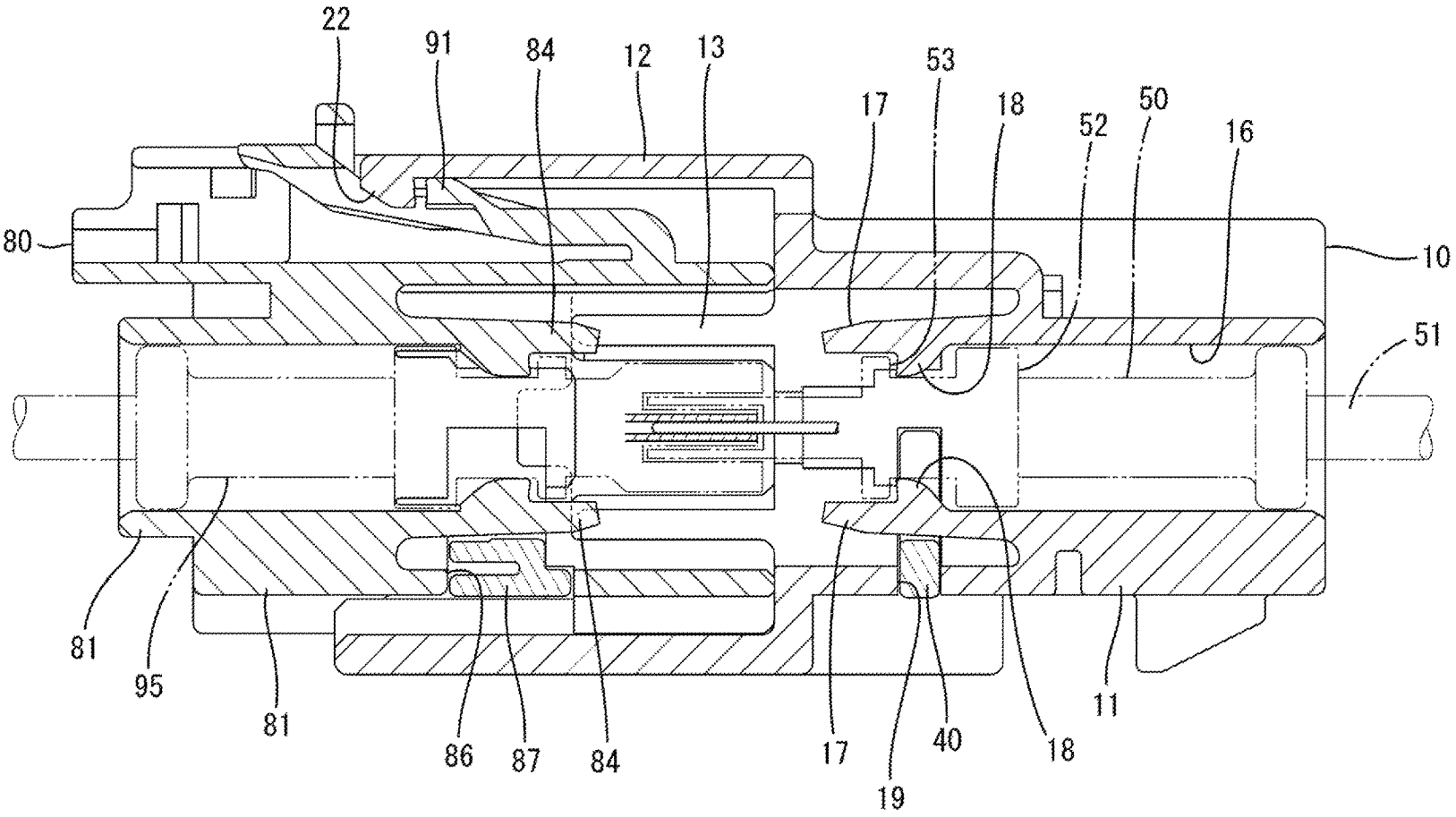
FIG. 1 is a section showing a state where a housing is properly connected to a mating housing in a connector of one embodiment of the present invention.

One specific embodiment of the present invention is described with reference to FIGS. 1 to 6. A connector of the embodiment includes a housing 10, a retainer 40, a first terminal fitting 50 and second terminal fittings 60. The housing 10 is connectable to a mating housing 80. The housing 10, the retainer 40 and the mating housing 80 are made of synthetic resin, and the first and second terminal fittings 50, 60 are made of conductive metal. Note that, in the following description, an end of the housing 10 facing the mating housing 80 at the start of connection is referred to as a front concerning a front-rear direction, and a vertical direction is based on each figure.

Figure 5:
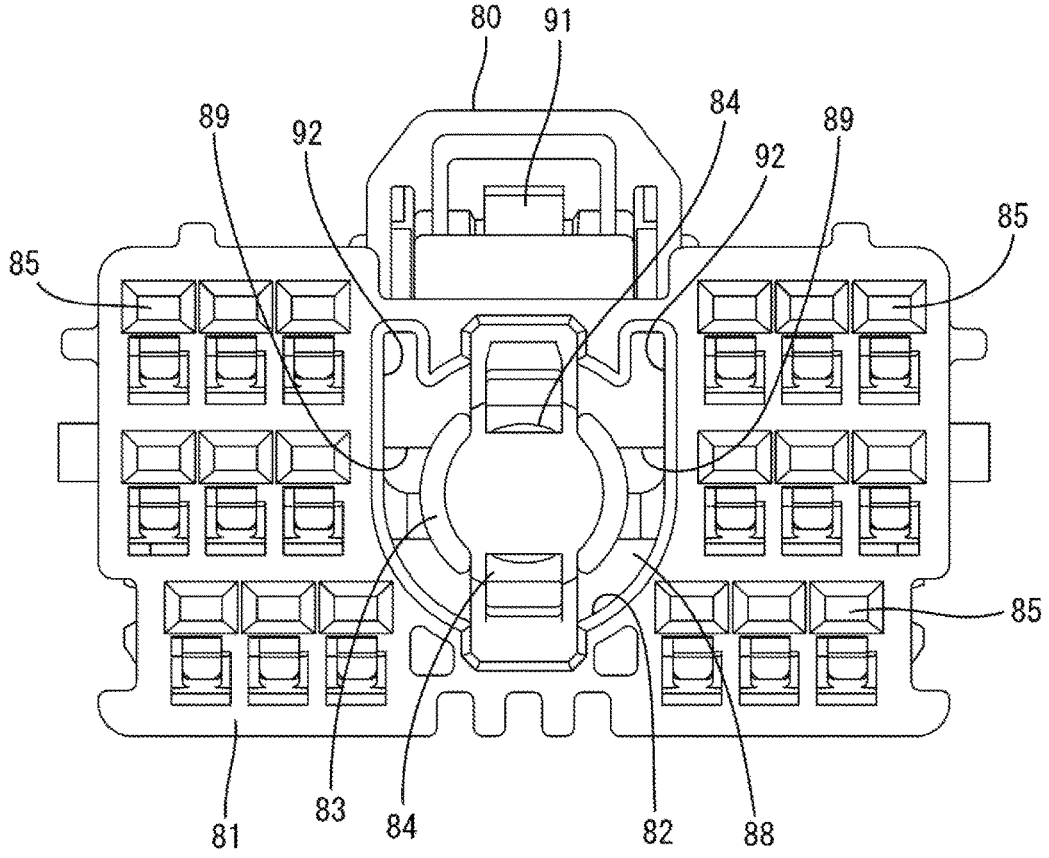
FIG. 5 is a front view of the mating housing.
Figure 6:
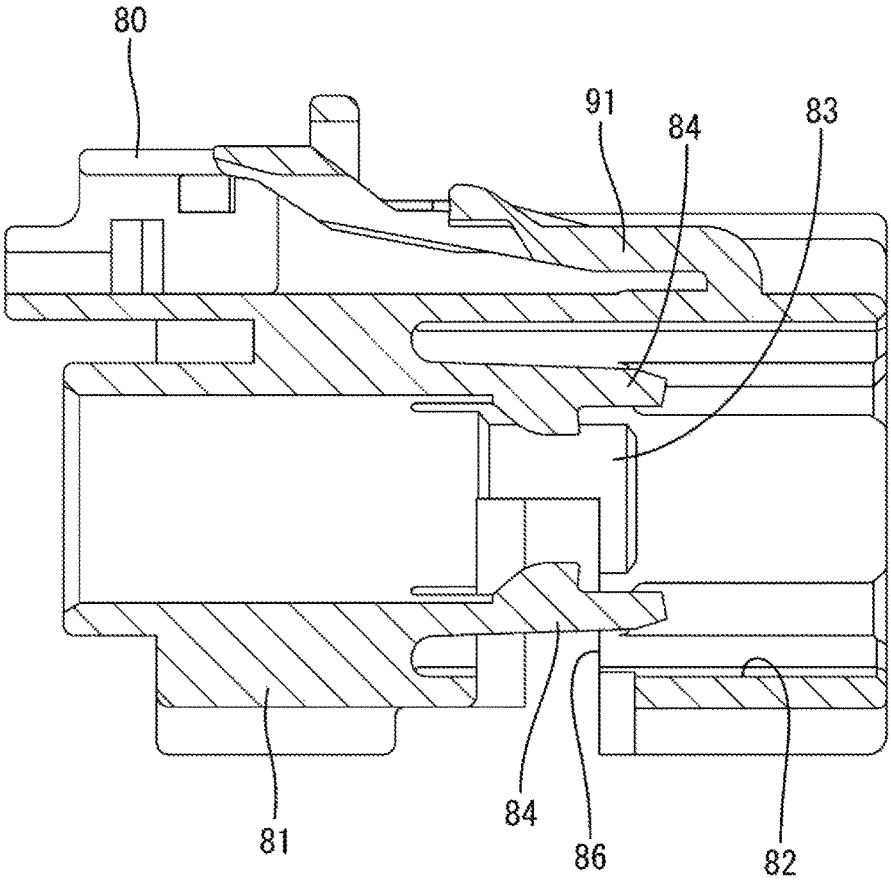
FIG. 6 is a section of the mating housing.

As shown in FIGS. 5 and 6, the mating housing 80 includes a housing body 81 substantially in the form of a rectangular block. Mating terminal fittings are accommodated in the housing body 81. The mating terminal fittings include two types of terminal fittings respectively connectable to the first and second terminal fittings 50, 60 to be described later.

As shown in FIG. 5, a forwardly open groove 82 is provided in a central part of the housing body 81 in a front view and is formed annularly on the outer periphery of a substantially cylindrical tubular portion 83. An inner receptacle 13, to be described later, can fit into the groove 82. A coaxial cable terminal 95 (see FIG. 1) corresponding to the first terminal fitting 50 is insertable into the tubular portion 83, and the tubular portion 83 includes a pair of mating locking lances 84 for locking the coaxial cable terminal 95 on upper and lower end parts. Further, as shown in FIG. 5, mating cavities 85 are provided in areas laterally outward of the groove 82 in the housing body 81, and the second terminal fittings 60 are inserted into the respective mating cavities 85.

As shown in FIG. 6, the housing body 81 is provided with a mating retainer mounting hole 86 open in lower and both side surfaces. As shown in FIG. 1, a mating retainer 87 is inserted into the mating retainer mounting hole 86. The mating retainer 87 is in the form of a synthetic resin plate that retains and holds the mating terminal fittings. As shown in FIG. 6, a part of the tubular portion 83 is cut at a position corresponding to the mating retainer mounting hole 86. Further, a locking part of the lower mating locking lance 84 is arranged at a position in the mating retainer mounting hole 86.

A thin separation wall 88 is provided between the groove 82 and the mating retainer mounting hole 86 in the housing body 81. As shown in FIG. 5, two insertion holes 89 are provided on both left and right sides of the separation wall 88 and penetrate from the groove 82 to the mating retainer mounting hole 86. Prying preventing pieces 25 to be described later are inserted into the respective insertion holes 89 when the housings 10, 80 are connected. Further, a deflectable lock arm 91 is provided on the upper surface of the housing body 81.

Figure 3:
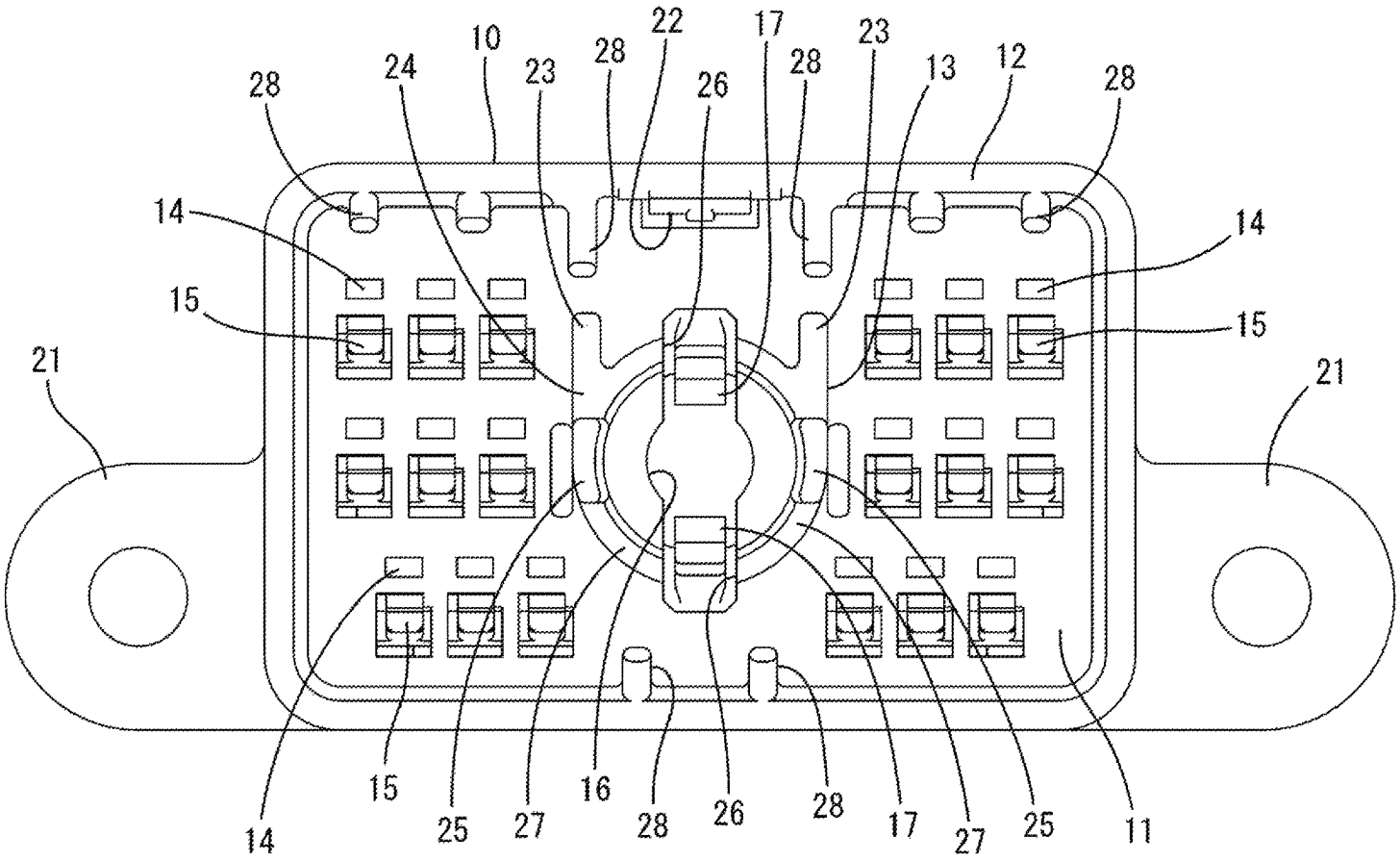
FIG. 3 is a front view of the housing.
Figure 4:
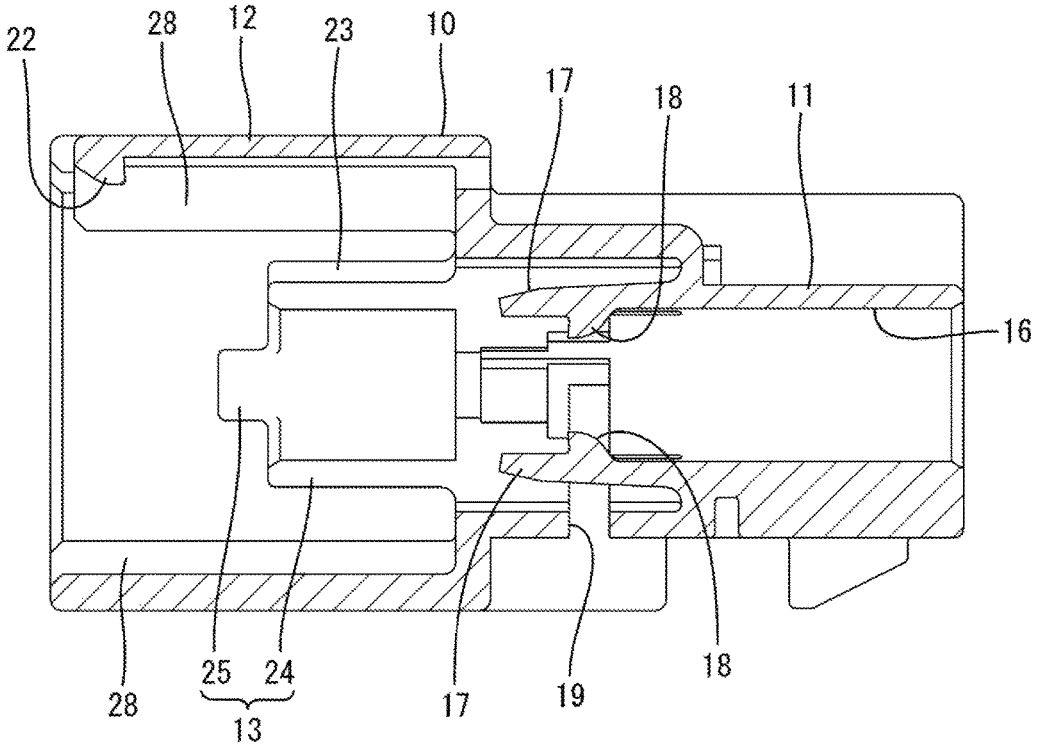
FIG. 4 is a section of the housing.

As shown in FIGS. 3 and 4, the housing 10 includes a terminal accommodating portion 11 in the form of a substantially rectangular block. A rectangular tubular outer receptacle 12 projects forward from the outer periphery of the front surface of the terminal accommodating portion 11. The inner receptacle 13 projects forward from a central part of the front surface of the terminal accommodating portion 11 and is a substantially cylindrical tube.

Cavities 14 penetrate through the terminal accommodating portion 11 in the front-rear direction. As shown in FIG. 3, the respective cavities 14 are aligned and arranged on both left and right sides across the inner receptacle 13 when viewed from the front. A small second locking lance 15 is cantilevered forward at an inner wall of each cavity 14.

The second terminal fitting 60 is connected to an end part of an unshielded wire and includes a box-like part (not shown), and a tab 61 (see FIG. 2) projects forward of the box-like part. The box-like part is locked by the second locking lance 15 to hold the second terminal fitting 60 in the cavity 14.

A circular insertion hole 16 penetrates a central part of the terminal accommodating portion 11 in the front-rear direction, as shown in the front view of FIG. 3, and communicates with the inside of the inner receptacle 13. The first terminal fitting 50 is inserted into the insertion hole 16, as shown in FIG. 1. Two large first locking lances 17 are cantilevered forward from upper and lower end parts of the insertion hole 16, and each first locking lance 17 is capable of locking the first terminal fitting 50. Locking projections 18 are provided near the tips of the first locking lances 17 and face each other. The tips of the first locking lances 17 are retracted rearward of the front surface of the terminal accommodating portion 11.

A retainer mounting hole 19 is open in the lower surface and both side surfaces of the terminal accommodating portion 11. The retainer mounting hole 19 communicates with the respective cavities 14 and the insertion hole 16. A plate-like retainer 40 is inserted into the retainer mounting hole 19 for retaining the first terminal fitting 50 and the second terminal fittings 60. As shown in FIG. 4, the locking projection 18 of the lower first locking lance 17 is arranged at a position in the retainer mounting hole 19.

As shown in FIG. 1, the first terminal fitting 50 is connected to the end part of a coaxial cable 51 and includes an external conductor 52 to be connected to a shield layer of the coaxial cable 51. The external conductor 52 has a circular cross-section and includes an annular recessed groove 53 on an outer periphery. The locking projection 18 of each first locking lance 17 is fit resiliently into the recessed groove 53 of the external conductor 52 to retain the first terminal fitting 15 in the insertion hole 61.

As shown in FIG. 3, two mounting portions 21 protrude on both left and right sides of a rear end part of the outer receptacle 12. The housing 10 is fixed to an unillustrated mounting target via the mounting portions 21.

A claw-like lock 22 is provided on a front end part of a laterally central part of the inner surface of the upper wall of the outer receptacle 12. As shown in FIG. 1, the lock 22 is locked resiliently to the lock arm 91 to hold the housings 10, 80 in a connected state. As shown in FIG. 3, peripheral ribs 28 extend in the front-rear direction on the inner surfaces of the upper and lower walls of the outer receptacle 12. The peripheral ribs 28 on the upper and lower walls are arranged vertically asymmetrically.

Figure 2:
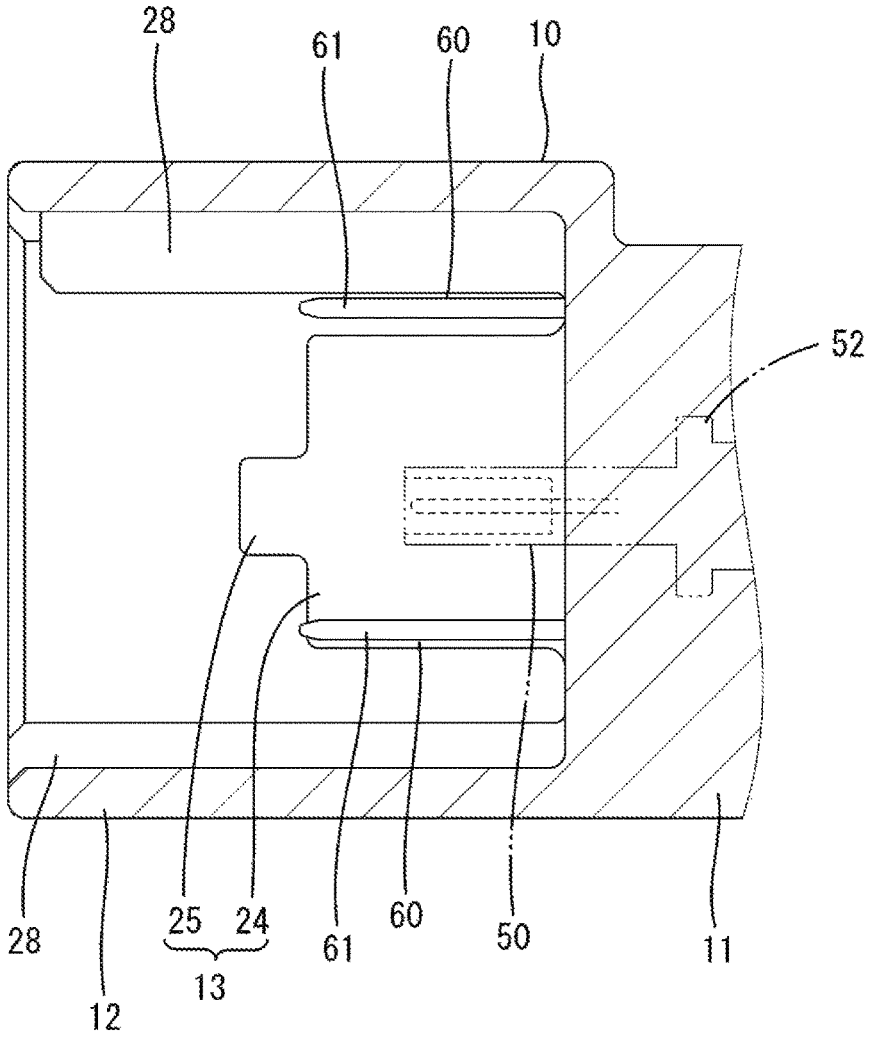
FIG. 2 is a section showing a state where the tip of an inner receptacle is located forward of the tips of first and second terminal fittings.

As shown in FIGS. 2 and 3, the inner receptacle 13 includes a substantially cylindrical tubular receptacle body 24 projecting forward from the front surface of the terminal accommodating portion 11 and two prying preventing pieces 25 project from the front end (tip) of the receptacle body 24. An inner diameter of the receptacle body 24 is larger than an inner diameter of the insertion hole 16.

As shown in FIG. 3, two slit openings 26 extend along the front-rear direction on upper and lower end parts of the receptacle body 24, and two arcuate peripheral walls 27 are arranged on both left and right sides across each slit opening 26. Each first locking lance 17 is located behind the corresponding slit opening 26 and can be confirmed visually from the front through the slit opening 26. Ribs 23 in the form of plate pieces are provided on both left and right ends of the receptacle body 24 and rise substantially vertically up from the corresponding peripheral walls 27. Each rib 23 extends over the entire length of the receptacle body 24 in the front-rear direction, the front end thereof stands along the vertical direction and the rear end thereof is formed into a closing end integrally connected to the front surface of the terminal accommodating portion 11. The mating housing 80 has two rib receiving portions 92 communicating with the groove 82, as shown in FIG. 5, to receive the respective ribs 23.

The respective prying preventing pieces 25 are in the form of plate pieces projecting forward from the front ends of both left and right sides of the receptacle body 24 and are parallel with the ribs 23 in the vertical direction. When the inner receptacle 13 is viewed from the front, the respective prying preventing pieces 25 and the respective slit openings 26 are arranged alternately with an angle difference of about 90°. Each prying preventing piece 25 has a substantially arcuate cross-section extending along a circumferential direction of the receptacle body 24, and the front end thereof is arranged to stand along the vertical direction. Note that the entire housing 10 including the inner receptacle 13 is bilaterally symmetrical with respect to an axis of symmetry in a laterally central part.

The structure of the connector of the embodiment is as described above. Next, functions and effects are described.

The second terminal fitting 60 is inserted into each cavity 14 of the terminal accommodating portion 11 and locked by the second locking lance 15. As a result, the tab 61 of each second terminal fitting 60 is arranged inside the outer receptacle 12 and outside the inner receptacle 13. At this time, the front end of the tab 61 of each second terminal fitting 60 is arranged behind the front end of the outer receptacle 12 and behind the front end of the inner receptacle 13 (see FIG. 2). Specifically, the front end of the tab 61 of each second terminal fitting 60 is arranged behind the front end of each prying preventing piece 25, but slightly before the front end of the receptacle body 24.

When the first terminal fitting 50 is inserted into the insertion hole 16 of the terminal accommodating portion 11 and locked by the first locking lance 17, a front part of the first terminal fitting 50 projects inside the inner receptacle 13. At this time, the front end of the first terminal fitting 50 is arranged behind the front end of the inner receptacle 13, specifically behind the front end of the receptacle body 24 (see FIG. 2).

If the mating housing 80 is inclined from a proper connection posture with respect to the housing 10 and, for example, either one of the left and right ends of the mating housing 80 enters the outer receptacle 12 earlier than the other when connecting the housings 10, 80, the housing body 81 contacts the tip of the prying preventing piece 25 of the inner receptacle 13 to restrict any further fitting movement of the mating housing 80. The front end of the first terminal fitting 50 and the front end of the tab 61 of each second terminal fitting 60 are located behind the front ends of the prying preventing pieces 25. Thus, the mating housing 80 cannot interfere with the front part of the first terminal fitting 50 and cannot deform the tabs 61 of the second terminal fittings 60 when the mating housing 80 in an oblique posture contacts the tip of the prying preventing piece 25. In other words, the prying of the first and second terminal fittings 50, 60 by the mating housing 80 is avoided.

The inner receptacle 13 is between the first terminal fitting 50 and the respective second terminal fittings 60 and inside the outer receptacle 12, specifically arranged in an inner central part. Thus, when the mating housing 80 in an oblique posture enters the outer receptacle 12, the mating housing 80 reliably interferes with the prying preventing piece 25 of the inner receptacle 13 and prevents prying connection of the mating housing 80.

The inner receptacle 13 has a substantially tubular shape to surround the outer periphery of the front part of the first terminal fitting 50. Thus, the front part of the first terminal fitting 50 cannot interfere with external matter other than the mating housing 80. That is, since the inner receptacle 13 has both a function of restricting prying connection and a function of protecting the first terminal fitting 50, a configuration can be simplified as compared to the case where both functions are realized by dedicated parts.

When the both housings 10, 80 are connected properly, the receptacle body 24 of the inner receptacle 13 is fit into the groove 82 of the mating housing 80 and each prying preventing piece 25 is fit into the corresponding insertion hole 89. Each prying preventing piece 25 projects from the tip of the receptacle body 24. Thus, the separation wall 88 can be left uncut at both sides of the insertion holes 89 and the groove 82 can be formed without any problem.

When the two housings 10, 80 are connected properly, the respective ribs 23 of the inner receptacle 13 are fit into the corresponding rib receiving portions 92. In contrast, if the mating housing 80 is inverted from the proper connection posture, the respective ribs 23 are not at positions corresponding to the rib receiving portions 92 and interfere with the housing body 81 to restrict a connection of the housings 10, 80. Thus, the inner receptacle 13 also has a function of restricting erroneous connection of the mating housing 80. In addition, since each rib 23 includes the closing end integrally connected to the front surface (wall surface on a back side) of the terminal accommodating portion 11, the strength of the inner receptacle 13 can be improved.

The invention is not limited to the above described and illustrated embodiment. For example, the following embodiments also are included in the scope of the invention.

The first and second terminal fittings may be distinguished by being arranged differently with respect to the inner receptacle and the outer receptacle and may be the same type of terminal fittings (including terminal fittings having the same shape). For example, the first terminal fitting may be a normal male terminal fitting to be connected to a wire having no shielding function similar to the second terminal fitting. Further, a plurality of first terminal fittings may be provided and, conversely, only one second terminal fitting may be provided.

The inner receptacle may not include the prying preventing pieces and the front end of the inner receptacle may be, for example, continuous without any irregularities in the circumferential direction at the same position in the front-rear direction. According to this configuration, an arbitrary part on the front end of the inner receptacle can interfere with the mating housing in an oblique posture and restrict prying connection of the mating housing.

LIST OF REFERENCE SIGNS

10 . . . housing
12 . . . outer receptacle
13 . . . inner receptacle
23 . . . rib
24 . . . receptacle body
25 . . . prying preventing piece
50 . . . first terminal fitting
60 . . . second terminal fitting
61 . . . tab
80 . . . mating housing
82 . . . groove

What is claimed is:

1. A connector, comprising:

an inner receptacle having an outer periphery;

an outer receptacle having an inner periphery spaced outward from and surrounding the outer periphery of the inner receptacle;

a first terminal fitting projecting inside the inner receptacle; and a plurality of spaced apart second terminal fittings spaced outward from the outer periphery of the inner receptacle and inward from the inner periphery of the outer receptacle;

a mating housing being configured to fit into the outer receptacle;

a forward-most part of the inner receptacle being located forward of tips of the first and second terminal fittings, and wherein the inner receptacle includes a tubular receptacle body having a front end and at least one prying preventing piece projecting from the front end of the receptacle body to the forward-most part of the inner receptacle.

2. The connector of claim 1, wherein the inner receptacle is arranged in an inner central part of the outer receptacle.

3. The connector of claim 1, wherein the inner receptacle and the outer receptacle project from a wall surface on a back side, at least one rib for restricting erroneous connection to the mating housing integrally projects on the inner receptacle, and the rib includes a closing end integrally connected to the wall surface.

4. The connector of claim 1, wherein the first terminal fitting is a coaxial terminal fitting having an external conductor connected to a shield layer of a coaxial cable, the external conductor being inward of the inner receptacle and spaced inward from the plurality of second terminal fittings.

5. The connector of claim 1, wherein the at least one prying preventing piece comprises a plurality of the prying preventing pieces spaced circumferentially from one another and projecting from the front end of the receptacle body.

* * * * *